United States Patent [19]

Rasocha

[11] Patent Number: 4,664,109

[45] Date of Patent: May 12, 1987

[54] MOUTHPIECE

[75] Inventor: Stanley Rasocha, Deerfield, Ill.

[73] Assignee: Dacor Corporation, Northfield, Ill.

[21] Appl. No.: 714,820

[22] Filed: Mar. 22, 1985

[51] Int. Cl.[4] ..... A62B 7/00

[52] U.S. Cl. ..... 128/207.14; 128/136; 128/201.11

[58] Field of Search ..... 128/207.14, 136, 204.26, 128/201.11, 62 A

[56] References Cited

U.S. PATENT DOCUMENTS

| | | | |
|---|---|---|---|
| 3,082,765 | 3/1963 | Helmer | 128/136 |
| 3;319,626 | 5/1967 | Lindsay | 128/136 |
| 3,496,936 | 2/1970 | Gores | 128/136 |
| 4,031,888 | 6/1977 | Walters | 128/201.11 |
| 4,136,689 | 1/1979 | Shamlian | 128/207.14 |
| 4,425,911 | 1/1984 | Luomanen et al. | 128/136 |
| 4,466,434 | 8/1984 | Brownstein | 128/136 |
| 4,568,280 | 2/1986 | Ahlin | 128/76 R |

*Primary Examiner*—John J. Wilson
*Attorney, Agent, or Firm*—Edmond T. Patnaude

[57] ABSTRACT

A mouthpiece for use with a breathing device has a pliable lip flange which fits between the lips and teeth of the user and a pair of bite lugs which extend from the lip flange between the user's teeth and wherein the upper and lower bite surfaces of the lugs are constituted by a plurality of resilient projections which are individually compressed by the teeth of the diver as he bites down on the lugs.

9 Claims, 5 Drawing Figures

MOUTHPIECE

The present invention relates in general to mouthpieces of the type used with breathing devices, and it relates more particularly to a new and improved mouthpiece having novel bite lugs which facilitate holding of the mouthpiece in the mouth of the user and thereby reduces jaw fatigue.

BACKGROUND OF THE INVENTION

Underwater breathing devices such as snorkels and regulators include mouthpieces which are retained in the mouth of the user and which prevent the ambient water from entering the mouth of the person using the device while permitting the free flow of gases through the mouthpiece to and from the mouth of the user.

The prior art mouthpieces have ordinarily been made of a flexible material such as rubber or plastic and include a lip flange which surrounds the opening through the mouthpiece through which the breathing gases pass. This flange is in the form of a flexible curved surface that fits between the lips and the outer frontal surface of the user's teeth to effect a seal between the ambient and the mouth of the user. The most common prior art mouthpieces further include a pair of lugs which extend from the flange on opposite sides of the breathing opening and are adapted to fit between the biting surfaces of the upper and lower teeth of the user. The user thus bites down onto the lugs to hold the mouthpiece in place within his mouth. Since the retainer lugs must be gripped firmly by the teeth over long periods of time in order to prevent dislodging of the mouthpiece, it is critical that the mouthpiece be comfortably held in the mouth of user. Indeed, in some cases the user's jaw might be damaged from a prolonged or excessively unnatural bite with the jaw bones unseated.

This problem has been recognized for many years and various solutions to it have been suggested. Accordingly, mouthpieces designed to reduce fatigue have been placed on the market. For example, one type of mouthpiece employs thermoplastic lug surfaces which are customized to have a shape complimentary to the shape of the biting surfaces of the teeth of the user (see U.S. Pat. No. 4,136,689 where one such mouthpiece construction is described). In another proposed solution to the problem the upper and lower halves of the mouthpiece are nonsymmetrical so as to conform to the natural overbite of a normal human jaw. Still another proposed solution was to replace the lip flange with a cup housing which was disposed externally of the mouth and sealed against the face of the user throughout a continuous area surrounding his mouth. Such a device is disclosed in U.S. Pat. No. 4,031,888.

SUMMARY OF THE INVENTION

Briefly, in accordance with the present invention there is provided a mouthpiece which includes a pliable lip flange for insertion between the lips and the outer surface of the adjacent teeth of the user, a plurality of bite lugs extending from the flange on opposite sides of a breathing opening through the flange for location between the biting surfaces of the teeth of the user, and a plurality of spaced apart, upstanding, resilient projections on the upper and lower biting surfaces of the lugs for respective engagement with the biting surfaces of the upper and lower teeth of user. The projections are individually compressed and reduce the force which is required for the user to exert on the lug. Moreover, the projections enable the diver to change the bite position of his teeth on the lugs while still maintaining a secure grip on the mouthpiece. It has been found that in this manner jaw fatigue is greatly reduced.

GENERAL DESCRIPTION OF THE DRAWING

The present invention will be better understood by a reading of the following detailed description taken in connection with the accompanying drawing wherein.

DETAILED DESCRIPTION OF A PREFERRED EMBODIMENT OF THE INVENTION

Figure 1:
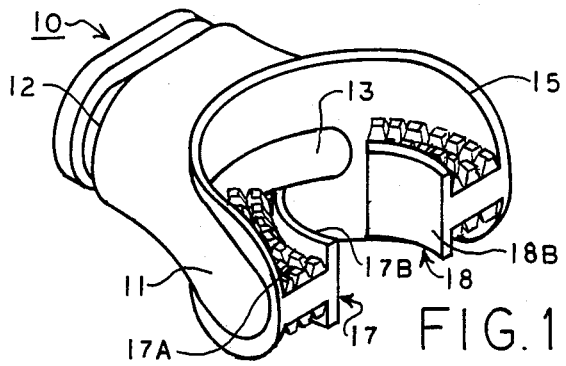
FIG. 1 is a perspective view of a mouthpiece embodying the present invention.

As may be seen in the drawings, a mouthpiece 10 includes a body portion 11 having a rear end portion 12 which is adapted to be connected to an associated breathing device such as snorkel or a breathing regulator. A central hole 13 extends completely through the body 11 from the rear end face thereof to provide a breathing passageway to the mouth of the person using the mouthpiece. The body 11 has a generally U-shaped section which terminates in a generally U-shaped, pliable lip flange 15 which surrounds the breathing opening 13 and is adapted to be positioned between the inside of the user's lips and the frontal surfaces of the front teeth of the user. The lip flange is thin and flexible and provides a seal between the mouthpiece and the lips of the user throughout an area surrounding the breathing hole 13. Users of the mouthpiece 10 may trim the edges of the flange 15 to customize the shape of the flange 15 to provide a more comfortable fit of the mouthpiece to the mouth.

In order to secure the mouthpiece in place within the diver's mouth so that it will not be inadvertently dislodged during exhaling or if the associated breathing device should be bumped or the like, a pair of bite lugs 17 and 18 extend from the inner surface of the flange 15 midway between the top and bottom thereof. It may be seen from the drawings that the lugs 17 and 18 are disposed on opposite sides of the hole 13 and respectively include upper and lower surfaces 17A and 18A which fit between the biting surfaces of the teeth of the user. The lugs 17 and 18 are further provided with flanges 17B and 18B which are adapted to extend along the inner surfaces of the teeth of the user. The lug flanges 17B and 18B are spaced from the lip flange 15 by a distance substantially greater than the normal corresponding width of the teeth of a human to provide for generally universal use of a given mouthpiece.

In the prior art mouthpiece constructions the bite surfaces 17A and 18A have been planar or they have been custom shaped so as to be complimentary to the biting surfaces of the teeth of the user where they engage the surfaces 17A and 18A during use of the mouthpiece.

Figure 2:
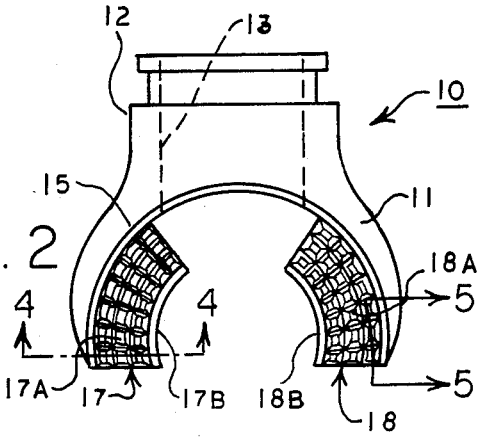
FIG. 2 is a top view of the mouthpiece of FIG. 1, it being understood that the mouthpiece is symmetrical about the central horizontal plane thereof, and therefor, a bottom view of the mouthpiece will look the same as the top view.
Figure 3:
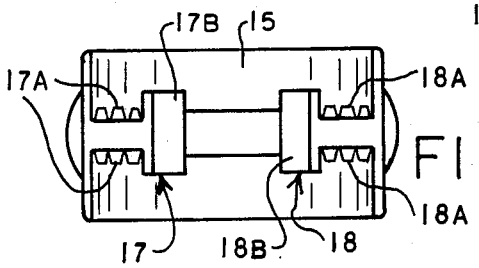
FIG. 3 is a rear view of the mouthpiece shown in FIG. 1.
Figure 4:
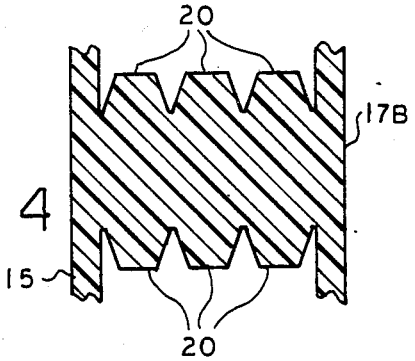
FIG. 4 is an enlarged, fragmentary cross-sectional view taken along the line 4—4 in FIG. 2.
Figure 5:
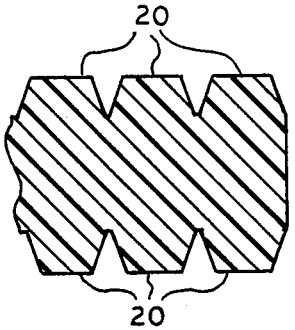
FIG. 5 is an enlarged, fragmentary cross-sectional view taken along the line 5—5 in FIG. 2.

In accordance with the present invention the bite surfaces of the lugs 17 and 18 are constituted by a plurality of upstanding resilient projections 20. Each of the projections is frusto-pyramidal in shape and the distal ends of the projections are flat and mutually coplanar as best shown in FIGS. 4 and 5. In the preferred embodiment of the invention the projections on each of the bite surfaces of the lugs are arranged in three generally parallel curved rows as best shown in FIG. 2. It will be understood, however, that the exact number and size of the projections is not critical. The height of the projections 20 as best shown in FIG. 4, is substantially less than the corresponding height of the lug flange 17B, and it has been found that as compared to the planar bite surfaces of the prior art mouthpieces, the plurality of resilient projections enables the diver to conveniently change the relative position of the mouthpiece relative to his teeth and thereby greatly relieve the normal fatigue associated with holding a mouthpiece at a fixed position in the mouth for extended periods of time.

In the preferred embodiment of the invention the entire mouthpiece is a one-piece molding of an elastomer such as rubber or plastic having a Duromater reading of between about 45 and 55 and a Shore A hardness. However, it is believed that a Duromater in the range of 40 to 70 will provide an acceptable mouthpiece. Also, although the entire mouthpiece as shown in the drawings is an integral one-piece part, it will be understood that where desired the bite surfaces of the lugs 17 and 18 can be formed of a material separate and different from the rest of the mouthpiece whereby the projections can, for example, be made of a material which is softer than that required for the remainder of the mouthpiece to provide adequate support for the breathing device which may be attached to it and held in place by the diver.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. A mouthpiece, comprising pliable lip flange means for insertion between the lips and the outer frontal surface of the teeth of a person using the mouthpiece, said lip flange means having a breathing hole extending therethrough for passing gas to and from the mouth of said person, a plurality of lugs connected to and extending from said lip flange on opposite sides of said hole for disposition between the biting surfaces of said teeth, and a multiplicity of individual, spaced apart, upstanding, resilient projections on the upper and lower sides of said lugs, the distal ends of said projections providing a multiplicity of spaced apart planar surfaces for abutment with the biting surfaces of said teeth.

2. A mouthpiece according to claim 1 comprising lug flange means at the ends of said lugs opposite said lip flange means for disposition against the inner faces of the teeth of the user.

3. A mouthpiece according to claim 2 wherein said projections are arranged in a plurality of rows.

4. A mouthpiece according to claim 1, comprising lug flange means respectively provided on the edges of said lugs opposite said lip flange means and extending parallel to said lip flange means, said projections being arranged in a plurality of rows of projections extending parallel to said lip flange means.

5. A mouthpiece according to claim 4 wherein said projections have mutually coplanar distal end surfaces.

6. A mouthpiece according to claim 4, wherein said plurality of rows comprises at least three rows.

7. A mouthpiece according to claim 6, wherein said mouthpiece is a unitary elastomeric molding.

8. A mouthpiece according to claim 1, wherein said projections are frusto-pyramidal.

9. A mouthpiece according to claim 8, wherein the distal end surfaces of said projections on one side of said lugs mutually coplanar.

* * * * *